US005342071A

United States Patent [19]

Soo

[11] Patent Number: 5,342,071

[45] Date of Patent: Aug. 30, 1994

[54] IN-LINE ROLLER SKATE BRAKE ASSEMBLY

[76] Inventor: Mike Soo, No. 430, Chung Shan Rd., Jen Teh Hsiang, Tainan Hsien, Taiwan

[21] Appl. No.: 58,878

[22] Filed: May 6, 1993

[51] Int. Cl.[5] ..... A63C 17/14

[52] U.S. Cl. ..... 280/11.22; 280/11.2; 280/11.28

[58] Field of Search ..... 280/11.2, 11.22, 11.23, 280/11.28; 188/29, 57

[56] References Cited

U.S. PATENT DOCUMENTS

| | | | |
|---|---|---|---|
| 834,526 | 10/1906 | Jones | 280/11.23 |
| 2,095,942 | 10/1937 | Wetterstrand | 280/11.23 |
| 3,339,936 | 9/1967 | Hamlin | 280/11.2 |
| 4,272,090 | 6/1981 | Wheat | 280/11.22 |
| 5,135,244 | 8/1992 | Allison | 280/11.22 X |

FOREIGN PATENT DOCUMENTS

| | | | |
|---|---|---|---|
| 2308148 | 8/1974 | Fed. Rep. of Germany | 280/11.28 |

*Primary Examiner*—Margaret A. Focarino
*Assistant Examiner*—Carla Mattix
*Attorney, Agent, or Firm*—Ralph F. Crandell

[57] ABSTRACT

An in-line roller skate which includes a base, a front brake assembly mounted on a front wheel assembly, and a rear brake assembly mounted on a rear wheel assembly. The front and rear brake assemblies are respectively mounted to the front and rear of the bottom of the base. The front wheel assembly includes a bridge member having first and second forked ends to which wheels are mounted and a mediate portion for mounting the front brake assembly. The mediate portion includes a receiving compartment for receiving the lower part of the front brake assembly. The compartment is designed to allow pivotal movement of the front brake assembly in the compartment. The front brake assembly further has a brake member at a front end thereof to contact with the frontmost wheel of the roller skate when braking. Similarly, the rear brake assembly has a brake member at a rear end thereof to contact with the rearmost wheel of the roller skate when braking.

7 Claims, 7 Drawing Sheets

IN-LINE ROLLER SKATE BRAKE ASSEMBLY

BACKGROUND OF THE INVENTION

The present invention relates to an in-line roller skate brake assembly.

The stop for a roller skate of the type with four wheels arranged in pairs is generally mounted to a front end of the roller skate, while the stop for an in-line roller skate is generally mounted to a rear end thereof for the purpose of fast-skating. Problems often occur for one acquainted with the first-mentioned type of roller skates to learn on the in-line roller skates. Furthermore, no means is provided between the base and the wheels of the in-line roller skates, such that when the roller skates encounter a rugged surface, shock will be transmitted to the skater and sometimes cause a beginner to fall.

Therefore, there has been a long and unfulfilled need for a roller skate with an improved brake means to mitigate and/or obviate the above-mentioned problems.

SUMMARY OF THE INVENTION

The present invention provides an in-line roller skate which includes a base, a front brake means mounted on a front wheel means, and a rear brake means mounted on a rear wheel means.

Means, such as bolts, may be provided to respectively secure front and rear brake means to the front and rear of the bottom of the base. Preferably, a ridge means consisting of two ridges extending longitudinally on the bottom side of the base may be provided in which the width between the two ridges is designed to fittingly receive the front and rear brake means to retain the front and rear brake means in position.

The front brake means is preferably identical to the rear brake means and the front wheel means is preferably identical to the rear wheel means, such that the elements can be interchanged and allow a quick assembling of the roller skate.

The front wheel means includes a bridge member having first and second forked ends to which wheels are mounted and a mediate portion for mounting the front brake means. The mediate portion includes a receiving compartment for receiving the lower part of the front brake means. The compartment is designed to allow pivotal movement of the front brake means in the compartment. The front brake means further has a brake member at a front end thereof. Before mounting the front brake means, a substantially U-shaped resilient member may be firstly inserted into the compartment of the bridge member and then the front brake means to absorb the shock that might come when on a rugged surface. Installation of the rear brake means and rear wheel means are the same as that described in the above.

When the skater wishes to brake the roller skate, he may simply lift his front portions of his feet. The rear brake means pivots downward and rearward such that the brake member thereof contacts with the rearmost wheel, thereby effecting the braking function. Alternatively, the skater may simply lift his heels of his feet. The front brake means pivots frontward such that the brake member thereof contacts with the frontmost wheel, thereby effecting the braking function.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
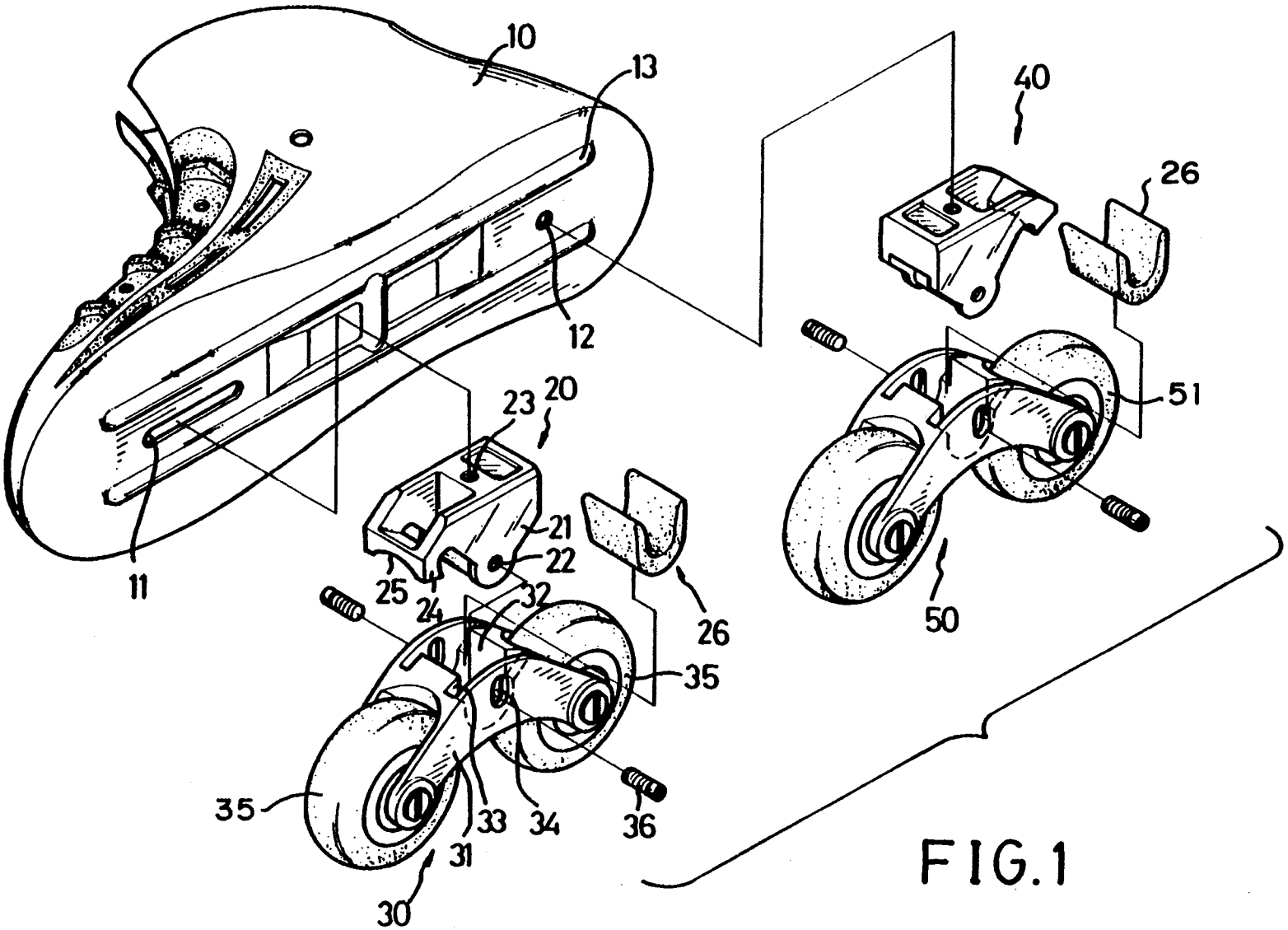
FIG. 1 is an exploded view of an in-line roller skate with a brake assembly in accordance with the present invention.
Figure 2:
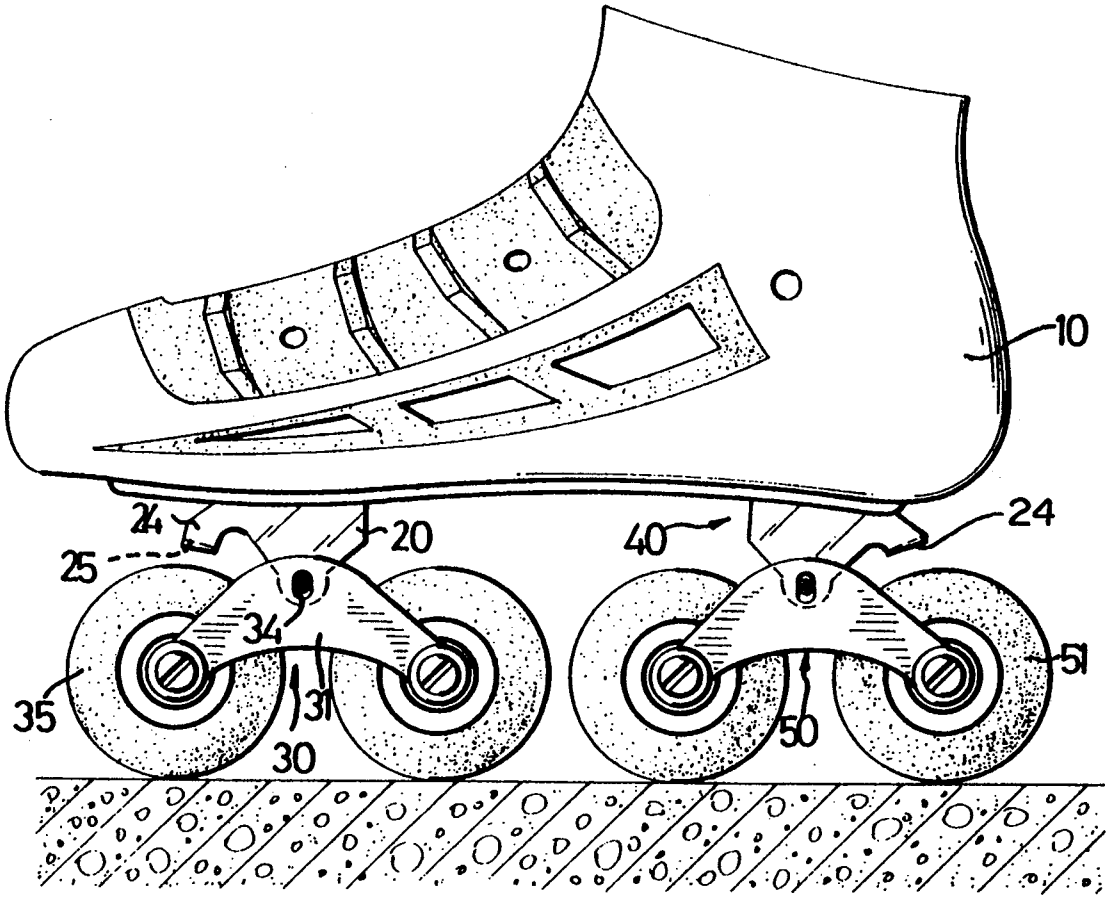
FIG. 2 is a schematic side view of the in-line roller skate in accordance with the present invention.

Referring to the drawings and initially to FIGS. 1 through 4, an in-line roller skate in accordance with the present invention generally includes a base 10 which is integrally formed of polyurethane (PU) or other suitable material, a front brake means 20 mounted on a front wheel means 30, and a rear brake means 40 mounted on a rear wheel means 50.

The base 10 includes an elongate hole 11 in a front portion of a bottom thereof and a hole 12 in a rear portion of the bottom thereof. A bolt (not shown) may be provided through the elongate hole 11 and the screw hole 23 of the front brake means 20 to secure the front brake means 20 to the front of the bottom of the base 10. Similarly, another bolt (also not shown) may be provided through the hole 12 and the screw hole 43 of the rear brake means 40 to secure the rear brake means 40 to the rear of the bottom of the base 10. Preferably, a ridge means 13 consisting of two ridges extending longitudinally on the bottom side of the base 10 may be provided. The width between the two ridges is designed to fittingly receive the front and rear brake means 20 and 40 to retain the front and rear brake means 20 and 40 in position. The provision of the elongate hole 11 allows the adjustment of the front brake means 20 and thus the front wheel means 30. Similarly, the hole 12 can be substituted by an elongate hole to allow adjustment of the rear wheel means 50.

The front brake means 20 is identical to the rear brake means 40 and the front wheel means 30 is identical to the rear wheel means 50. The front wheel means 30 includes a bridge member 31 having first and second forked ends to which wheels 35 are mounted and a mediate portion for mounting the front brake means 20. As shown in FIG. 1, the mediate portion includes a receiving compartment 32 for receiving the lower part of the front brake means 20 by grub screws 3 6 pas sing through the elongate holes 34 of the mediate portion of the bridge member and two holes 22 (only one is shown) in the lower part of the front brake means 20. The compartment 32 is substantially U-shaped and includes grooves 33 extending along a longitudinal axis thereof to allow pivotal movement of the front brake means 20 in the compartment 32 about an axis defined by the grub screws 36. The front brake means 20 further has a brake member 24 at a front end thereof to contact with the frontmost wheel 35 when braking. Similarly, the rear brake assembly has a brake member at a rear end thereof to contact with the rearmost wheel 51 of the roller skate when braking. Preferably, the brake member 24 is arcuate in section (see reference numeral 25). Before mounting the front brake means 20, a substantially U-shaped resilient member 26 may be firstly inserted into the compartment 32 of the bridge member 31 (see FIG. 5) and then the front brake means 20, the function of which will be described later. Installation of the rear brake means 40 and rear wheel means 50 are the same as that described in the above and therefore will not be redundantly described.

Figure 3:
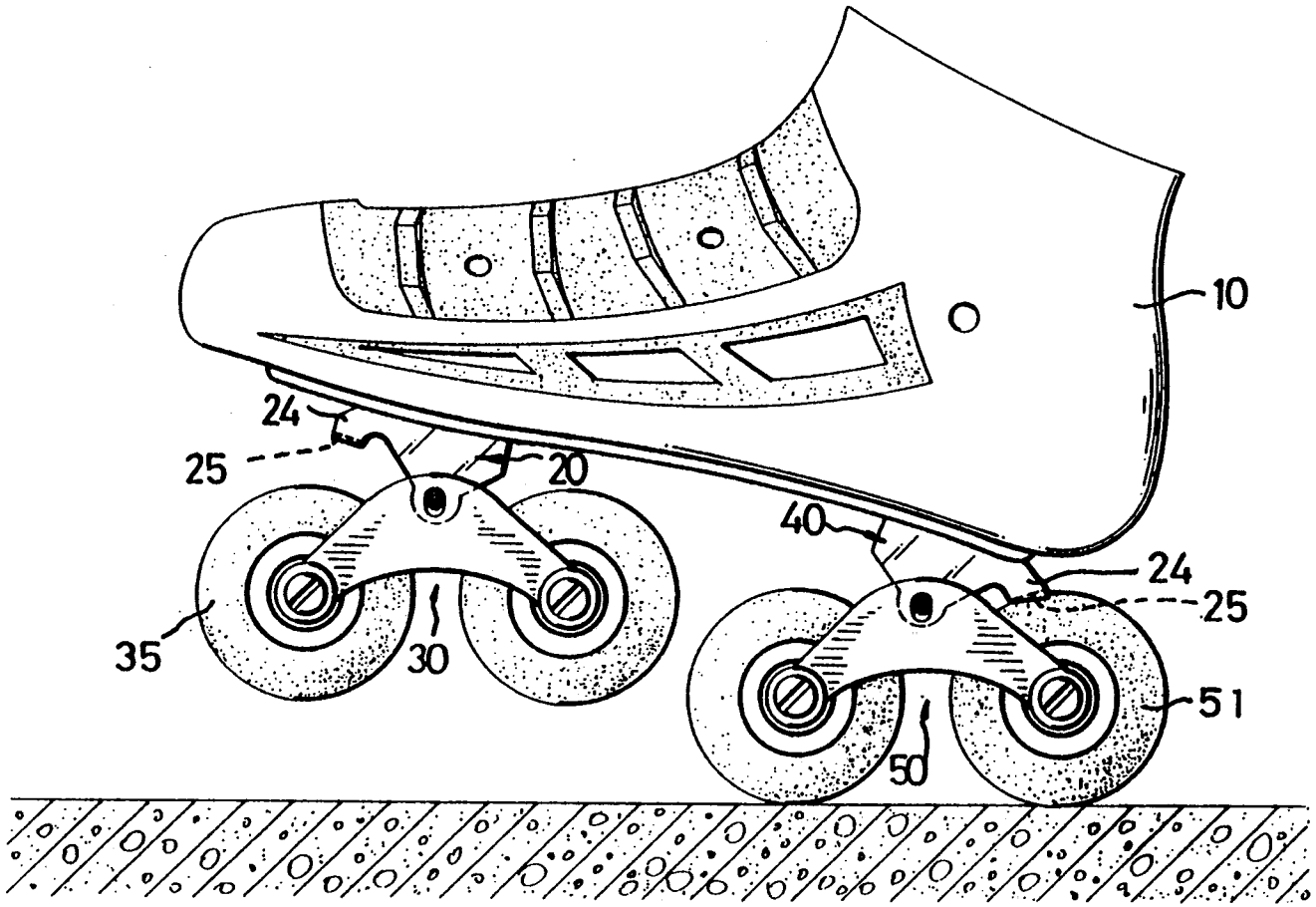
FIG. 3 is a schematic side view showing an operation of braking the roller skate by the rear brake means.
Figure 4:
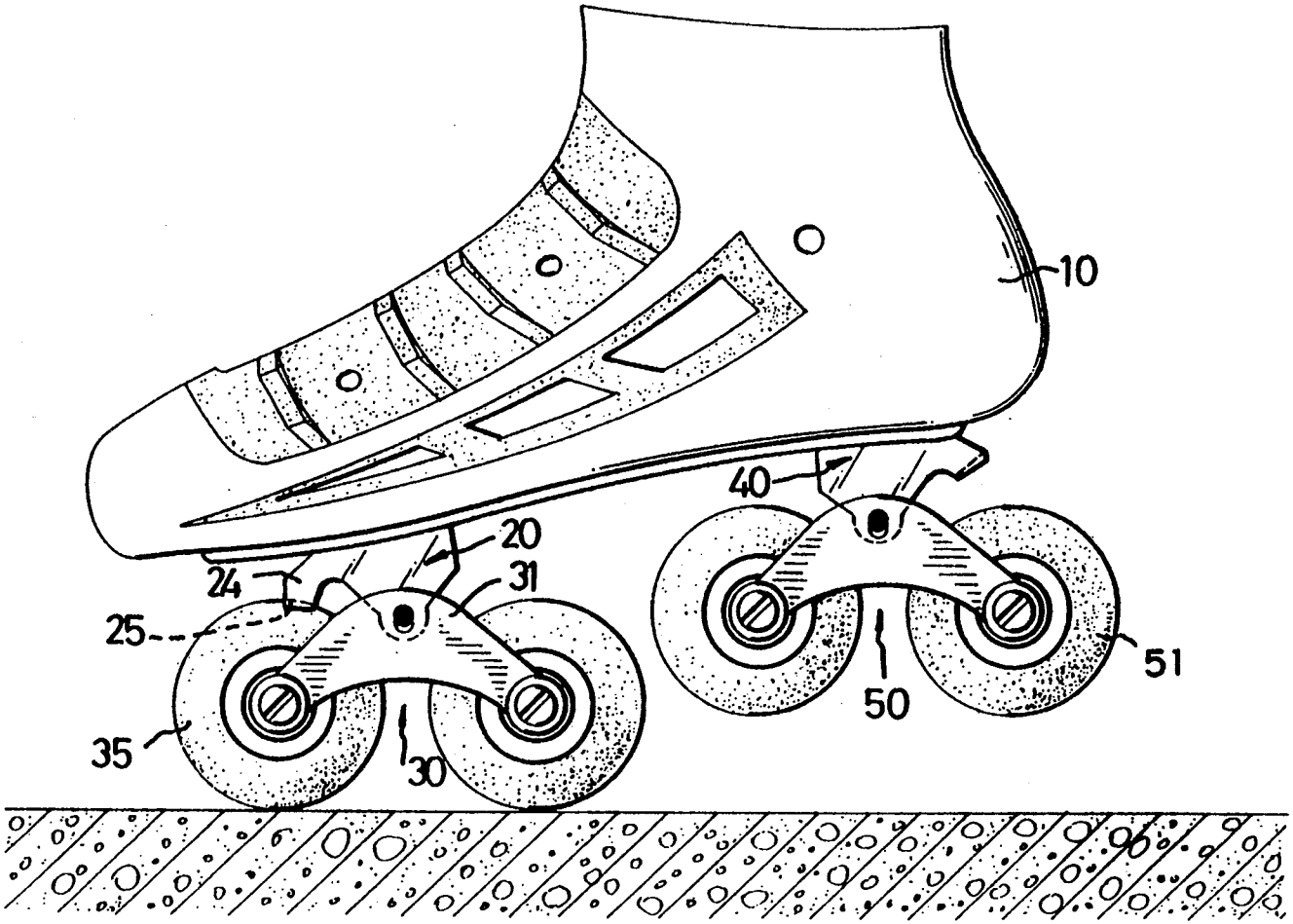
FIG. 4 is a schematic side view showing an operation of braking the roller skate by the front brake means.

Referring now to FIG. 3, when the skater wishes to brake the roller skate, he may simply lift his front portions of his feet. The rear brake means 40 pivots downward and rearward such that the brake member 24 thereof contacts with the rearmost wheel 51, thereby effecting the braking function. Alternatively, the skater may simply lift his heels of his feet. The front brake means 20 pivots downward and frontward such that the brake member 24 thereof contacts with the frontmost wheel 35, thereby effecting the braking function, as shown in FIG. 4.

Figure 5:
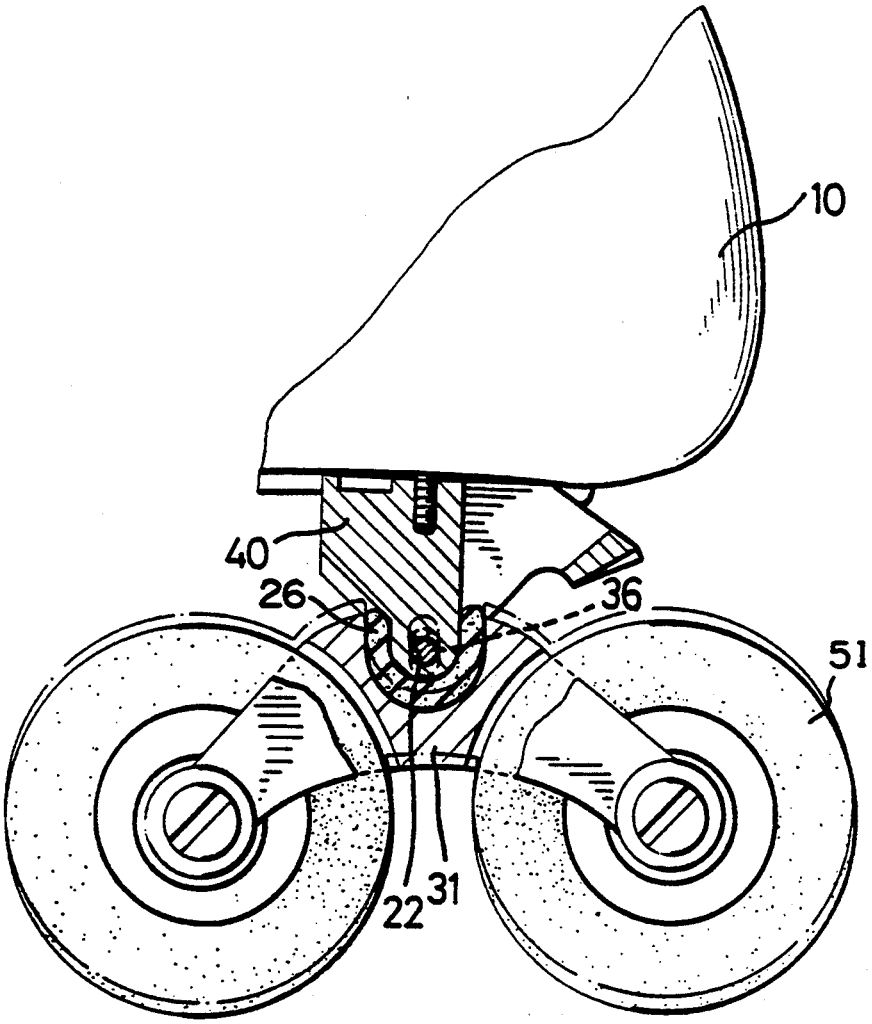
FIG. 5 is a schematic partial view, in an enlarged scale, of the roller skate showing the shock-absorbing function thereof.

Referring to FIG. 5, when the roller skate encounters a shock, e.g., when skating on a relatively rugged road or encounters a relatively large piece of gravel, the resilient member 26 absorbs relatively large portion of the shock and thus reduces the impact to the skater.

Figure 6:
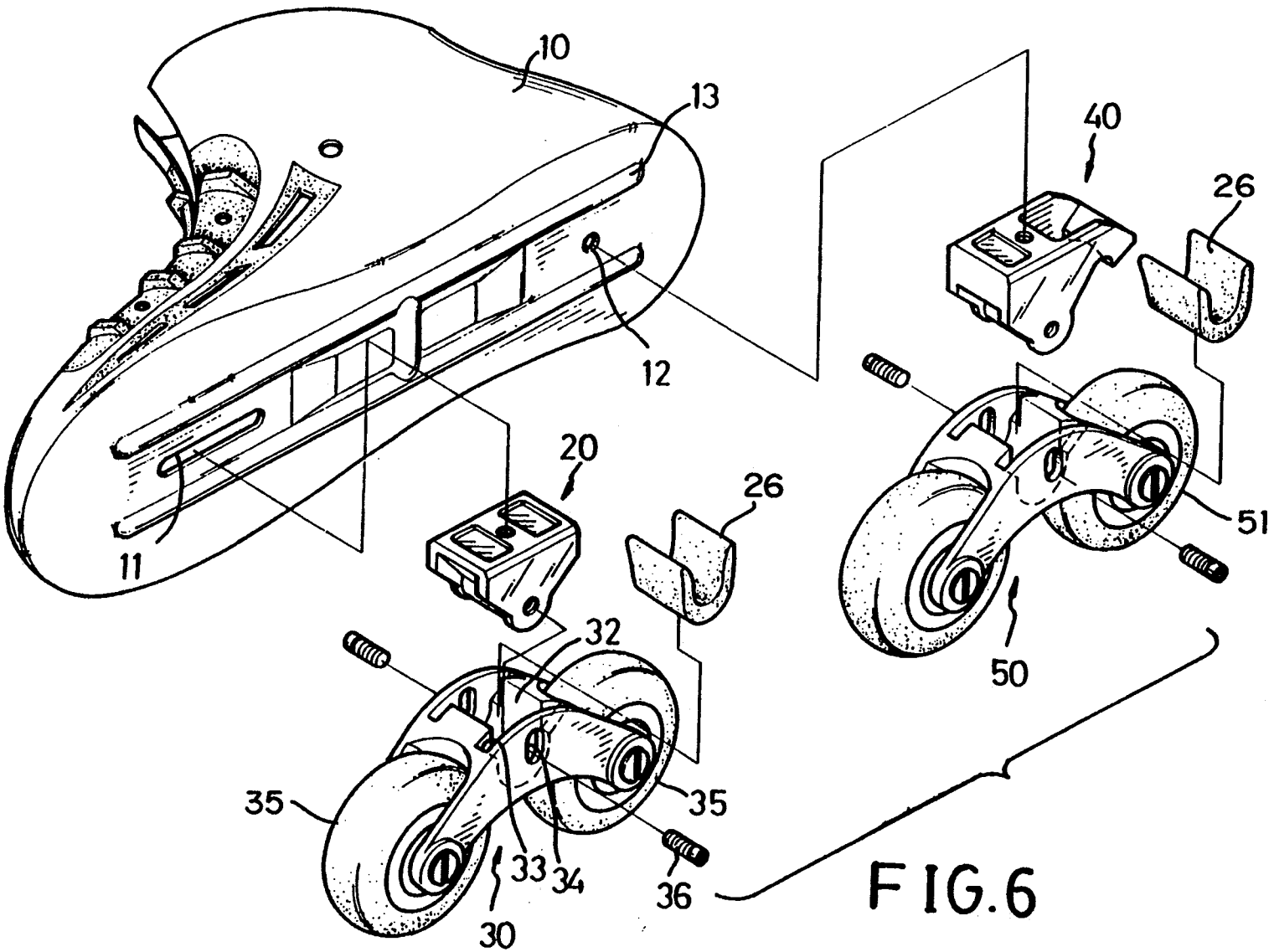
FIG. 6 is an exploded view showing another embodiment in accordance with the present invention.
Figure 7:
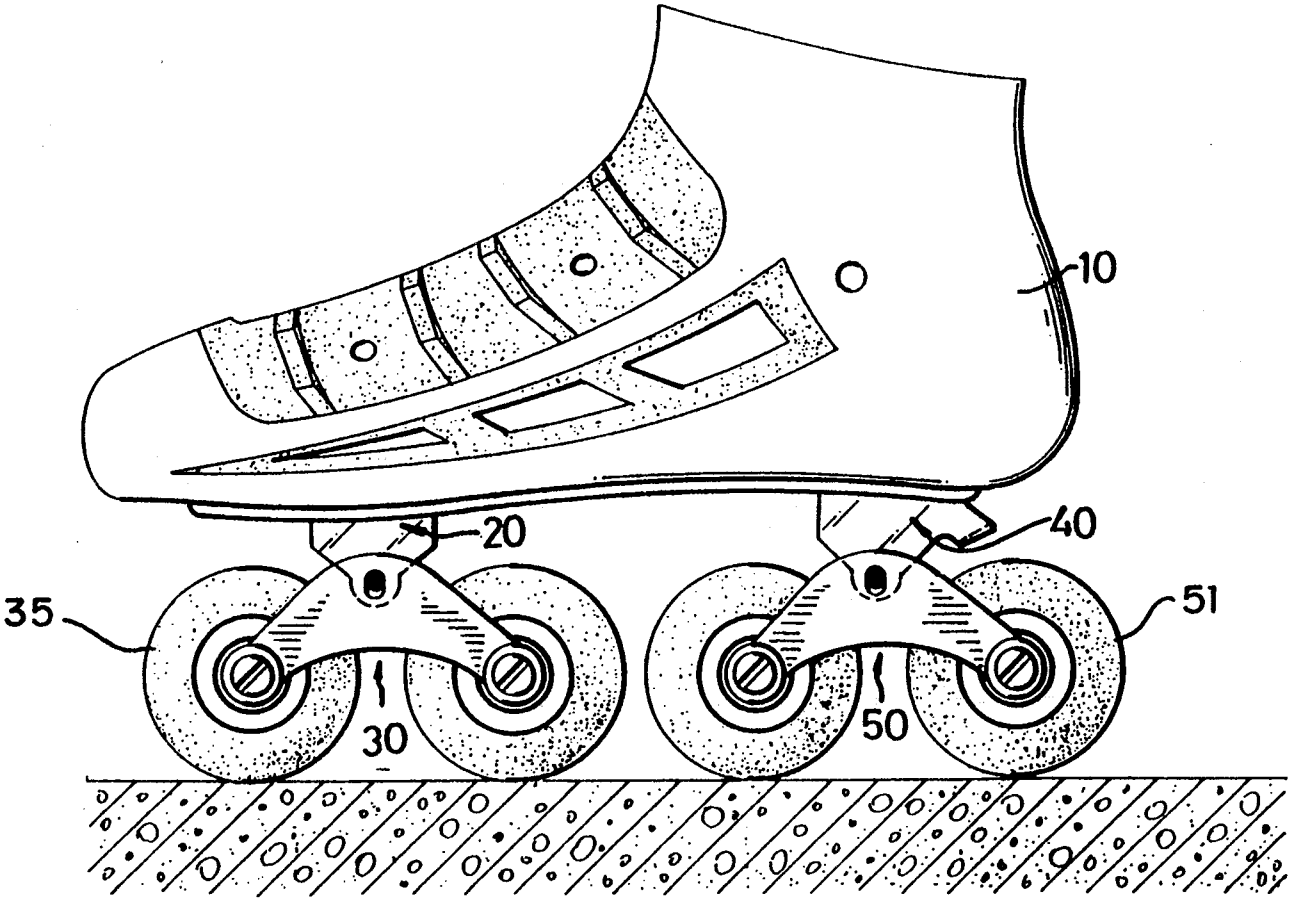
FIG. 7 is a schematic side view of the roller skate in FIG. 6.

FIGS. 6 and 7 show another embodiment of the present invention in which only the rear brake means is equipped with the brake member and thus only allows the braking by means of the rear brake means. It is, nevertheless, appreciated that the brake member 24 can be provided on the front brake means instead of the rear brake means.

The present invention has the following advantages:

(1) the skater may brake the roller skates at his discretion;

(2) the roller skate can be easily and quickly assembled and the maintenance therefor is low due to the identical nature of the front and rear wheel means and front and wheel brake means;

(3) the roller skate has a better shock absorbing effect; and (4) the position of the front and rear wheel means can be adjusted.

Although the invention has been explained in relation to its preferred embodiment, it is to be understood that many other possible modifications and variations can be made without departing the spirit and scope of the invention as hereinafter claimed.

I claim:

1. An in-line roller skate comprising:

a base with a bottom side;

a front wheel means;

a rear wheel means;

a front brake means with an upper side thereof secured to a front of said bottom side of said base and a lower side thereof pivotally mounted to said front wheel means, said front brake means comprising a brake member at a front thereof for contacting with a frontmost wheel of said roller skate during braking;

a rear brake means with an upper side thereof secured to a rear of said bottom side of said base and a lower side thereof pivotally mounted to said rear wheel means, said rear brake means comprising a brake member at a rear thereof for contacting with a rearmost wheel of said roller skate during braking;

each of said front and rear wheel means including a bridge member having first and second forked ends to which wheels of said roller skate are mounted and a mediate portion for mounting an associated front or rear brake means, said mediate portion defining a compartment for receiving said lower side of an associated front or rear brake means, and hole means to pivotally mount said lower side of an associated front or rear brake means in said mediate portion.

2. The in-line roller skate as claimed in claim 1 wherein said base includes an elongate hole in a front portion of said bottom side thereof for adjustably mounting said front brake means.

3. The in-line roller skate as claimed in claim 1 wherein said base includes an elongate hole in a rear portion of said bottom side thereof for adjustably mounting said rear brake means.

4. The in-line roller skate as claimed in claim 1 wherein a ridge means is provided on said bottom side of said base to fittingly receive said upper sides of said front and rear brake means.

5. The in-line roller skate as claimed in claim 4 wherein said ridge means includes two ridges extending longitudinally on said bottom side of said base.

6. The in-line roller skate as claimed in claim 1 wherein each said compartment is substantially U-shaped and includes grooves extending along a longitudinal axis thereof to allow pivotal movement of an associated front or rear brake means in said compartment.

7. The in-line roller skate as claimed in claim 6 wherein a substantially U-shaped member is received in each said compartment between an associated front or rear brake means and said bridge member.

* * * * *